US006423954B1

(12) United States Patent
Zettergren

(10) Patent No.: US 6,423,954 B1
(45) Date of Patent: Jul. 23, 2002

(54) SHIELDING METHOD DURING MICROWAVE RADIATION DRYING

(76) Inventor: Leif Gösta Zettergren, Apelsinvägen 36, Järfälla (SE), S-175 49

( * ) Notice: Subject to any disclaimer, the term of this patent is extended or adjusted under 35 U.S.C. 154(b) by 0 days.

(21) Appl. No.: 09/694,558

(22) Filed: Oct. 23, 2000

Related U.S. Application Data

(63) Continuation of application No. PCT/SE99/00720, filed on Apr. 29, 1999.

(51) Int. Cl.[7] ..... H05B 6/76

(52) U.S. Cl. ..... 219/738; 219/679; 219/745; 34/259; 174/35 R

(58) Field of Search ..... 219/678, 679, 219/736, 738, 745, 728, 729; 34/259, 264; 174/35 R, 35 MS

(56) References Cited

U.S. PATENT DOCUMENTS 4,370,534 A * 1/1983 Brandon ..... 219/738
4,656,325 A * 4/1987 Keefer ..... 219/728

FOREIGN PATENT DOCUMENTS

DE 44 20 649 A 1 12/1995
SE 9400751-0 9/1995
SE 9503308-0 3/1997
WO WO 92/08084 5/1992
WO WO 95/23945 9/1995
WO WO 97/21060 6/1996
WO WO 97/11579 3/1997

* cited by examiner

*Primary Examiner*—Philip H. Leung
(74) *Attorney, Agent, or Firm*—Pennie & Edmonds LLP

(57) ABSTRACT

Method for shielding against dangerous microwave radiation during drying of a surface of a water damaged building part by one or more mobile unit(s) emitting microwave radiation against the surface that is being dried, which method comprises installing a temporary, easily applied and removed, metal foil as a partially covering of the surface to be dried so that microwave radiation can be reflected back onto the surface to be dried while allowing evaporated water to escape from the surface at uncovered areas. The foil is applied to cause the radiation to pass through at least 50 cm of the building material to utilize the inherent quenching effect of the building material to help dry the water damaged building part surface. Preferably, the foil is an aluminum foil and the building part is a ceiling, floor, or a wall of a building, and the foil is applied to surround the building part except in the area(s) of the mobile unit(s).

6 Claims, 4 Drawing Sheets

SHIELDING METHOD DURING MICROWAVE RADIATION DRYING

CROSS-REFERENCE TO RELATED APPLICATIONS

This application is a continuation of the U.S. national stage designation of PCT application PCT/SE99/00720 filed Apr. 29, 1999, the content of which is expressly incorporated herein by reference thereto.

TECHNICAL FIELD

Microwave technology brings great advantages for heating of different kinds. For that reason it is used to an increasing extent. Microwaves are considered to cause danger for damages to many organisms including humans and other warm-blooded animals. A fundamental condition at all uses of microwave technology is a reliable shielding against leakage of microwaves.

BACKGROUND OF THE INVENTION

When microwaves are used in closed chambers such as ovens, etc. shielding is no large problem. Metals are good reflectors for microwaves and do not let through radiation. Even where a certain degree of ventilation is required shielding can, with relative ease, be arranged by perforated plates or nets of a suitable metal. The apertures in the plate or net must be dimensioned not to let radiation through.

The situation becomes more complicated, when microwaves are used for treatment of water damages at ceilings, walls and floors. Examples of such use can be found in the Swedish patent No. 9400751-0, PCT/SE95/00219 and PCT/FI91/00330 where small, mobile, microwave units, consisting of a, downwards open, parallel-epipedic, plate container comprising one or more microwave generators with micro wave outputs in the range 500 to 1500 kw, are used. Suitable dimensions for such units, containing one magnetron with an input effect between 1 and 3 kilowatts, are a quadratic or rectangular opening with sides between 40 and 60 centimetres.

Problematic areas with respect to shielding at such use are the area close to the apparatus, where radiation may leak out at the gap between the apparatus enclosure and the floor or the other surfaces dried, and the rooms situated behind the floor, the wall or the ceiling dried. The first problem has got a simple and good solution, which is described in the Swedish patent No. 9503308-0 and the corresponding international application No PCT/SE96/01170, where widening of the bottom border of the apparatus enclosure is used for obtaining a barrier for microwave radiation. For the second and more difficult problem, penetrating radiation, a solution with good function has been lacking. Instead one has been forced to introduce restrictions with respect to accessibility and use of these rooms. This has made use of microwaves for drying of water damaged building parts more complicated and expensive.

As told, inter alia, in PCT/SE95/00219 use of microwave technique for drying of water damaged building parts involves very large time gains and much less inconvenience for people living in or in other ways using the buildings sanified. Risk of dangerous microwave radiation reduces these advantages, as it may enforce evacuation and closing of rooms that otherwise would have been available during the sanifying phase. Thus it is important to find technique that limits the need for evacuation to the room where the equipment is working only.

PCT/DE96/02231 describes use of microwaves for drying of buildings and building parts. Even if intrusive humidity is mentioned in passing, the description makes it clear that the purpose is elimination of so-called construction humidity, i.e. water in mortar, concrete etc. The shielding aspect is touched upon very superficially. One uses either a metal net placed under the grouting on the outer sides of ceilings, walls and floors, in this way literally converting the room to a "microwave oven", or a mobile reflector plate at the opposite side of the surface being dried. In both cases the condition for obtaining a shielding effect is the accessibility existing during the building phase, but usually not after that the building has been finished and taken into use.

DE 4420649 A1 and DE 9413736 U1 describes use of microwaves for drying and control of fungus attack. With one exception the embodiments concern wooden structures of different kinds. For the drying of a not filled, water damaged wooden floor structures with wood coverings at upper and under sides, covering of both sides with metal foil is proposed. A hole is made in the upper covering, where the microwave source is placed, so that the radiation can penetrate down into the floor structure.

The arrangement presupposes an open floor structure with channels, to make evacuation of humidity possible. Wooden structures of this kind have very low quenching effect on microwaves. This is especially true in dry condition. Thus the covering must reach so far outside the microwave source that the radiation's decay in air is sufficient for decreasing the intensity to a safe level.

The arrangement cannot be used for concrete structures, filled structures, building bricks etc. where channels for evacuation of humidity are lacking. In such cases a fundamental condition is that at least one side is left free to let out evaporated water. The method is also inconsistent with the requirement for mobility of the microwave source that is a fundamental prerequisite for use of the methods described in PCT/SE95/00219.

None of these earlier publications give any guidance for solving shielding problems arising when microwaves are used for the sanifying of already occupied flats. Such a solution must be safe and cheap. Otherwise, the profitability of microwave methods is decreased in comparison to other alternatives. Further, the shielding must be easy to install and just as easy to remove after finished work, without leaving remaining traces on wall paper and painting. Another desideratum is that the shielding should allow undisturbed activity in rooms next to the space, where sanifying and drying goes on.

SUMMARY OF THE INVENTION

The inventor has observed that many building materials have large capacity for quenching microwave radiation with frequency around 2,45 GHz, which is usually used for microwave ovens and similar applications. This is a fundamental prerequisite for heating by microwaves. The quenching corresponds to the desired heating. The quenching depends to a substantial part on the water content in the material. Thus, it decreases with diminishing water content. However, some building materials, which in dry condition contain substantial amounts of crystal water, such as concrete, inclusive light concrete and gypsum, have even after drying sufficient quenching capacity for obtaining reliable protection.

A prerequisite for this is that ceilings, walls or floors are sufficiently thick to cause the quenching required, so that humans and animals without risk for injuries can stay in adjacent spaces. The invention concerns simple means to extend the distance through the quenching material that the radiation has to pass before reaching the air, where the decay is slow.

Thus, this method improves the use of the inherent quenching capacity of the building material by governing the ray path. Besides reliable shielding, the method gives energy gains by using, for evaporation of water, the energy in the radiation that otherwise would have escaped through the floor, wall or ceiling. The method implies that the radiation that penetrates the wall, the floor or the other constructions treated is reflected back into the building material by a metal foil, which has been applied close to the outer surface.

The method of the invention is meant for use at microwave treatment of closed spaces, i.e. spaces limited by walls, floors and ceilings, where it is desirable that humans and/or animals, without risk for injury, can live just outside, under or over the space, where one or more microwave units are working. Use of the method considerably improves the usability of mobile, automatic governed microwave units, such as those described in the mentioned PCT/SE95/00219.

The present invention concerns a method for shielding against penetrating radiation at drying or other treatment of surfaces.

The method of the invention means that a thin, metal foil, especially an aluminium foil is used for partial covering of walls, ceilings, floors and similar surfaces. For surfaces that do not need drying, the covering may be applied to the side, where the microwave unit is placed. For surfaces that have to be dried, the covering is applied to the opposite side of the wall respectively floor. For building materials that in dry condition also contain substantial amounts of water as crystal water and comparatively little voids such as concrete, it is usually sufficient if the outer border of the foil is situated at least 50 cm from the centre of the microwave source. For other building materials, such as wood and brick and constructions, where the wall or the floor structure has air-filled cavities, the distance may have to be increased. As a rule 140 cm are sufficient in most cases. It is no disadvantage, but no advantage either, if the shielding reaches farther out.

BRIEF DESCRIPTION OF THE DRAWINGS

FIG. 1: Foil installation type 1, for instance, a mobile machine on rails in a bathroom on ground. Concrete, light concrete, bricks or gypsum+crossbars+gypsum walls, foil around the whole room.

FIG. 2: Foil installation type 2, for instance. a mobile machine on rails in bath room over another bath room. Concrete floor, concrete or light concrete walls.

FIG. 3: Elementary installation of foil used routinely at floor drying and completed when needed as in FIG. 4.

FIG. 4.: Complement installation of gypsum+crossbars+gypsum walls. Foil strip at the angle between ceiling and wall in the storey below.

FIG. 5: Machine opening against a light concrete wall. Foils at the opposite side of the wall 30 cm over the upper border of the machine and turned in 30 cm over the floor.

DETAILED DESCRIPTION OF THE PREFERRED EMBODIMENTS

Figure 7:
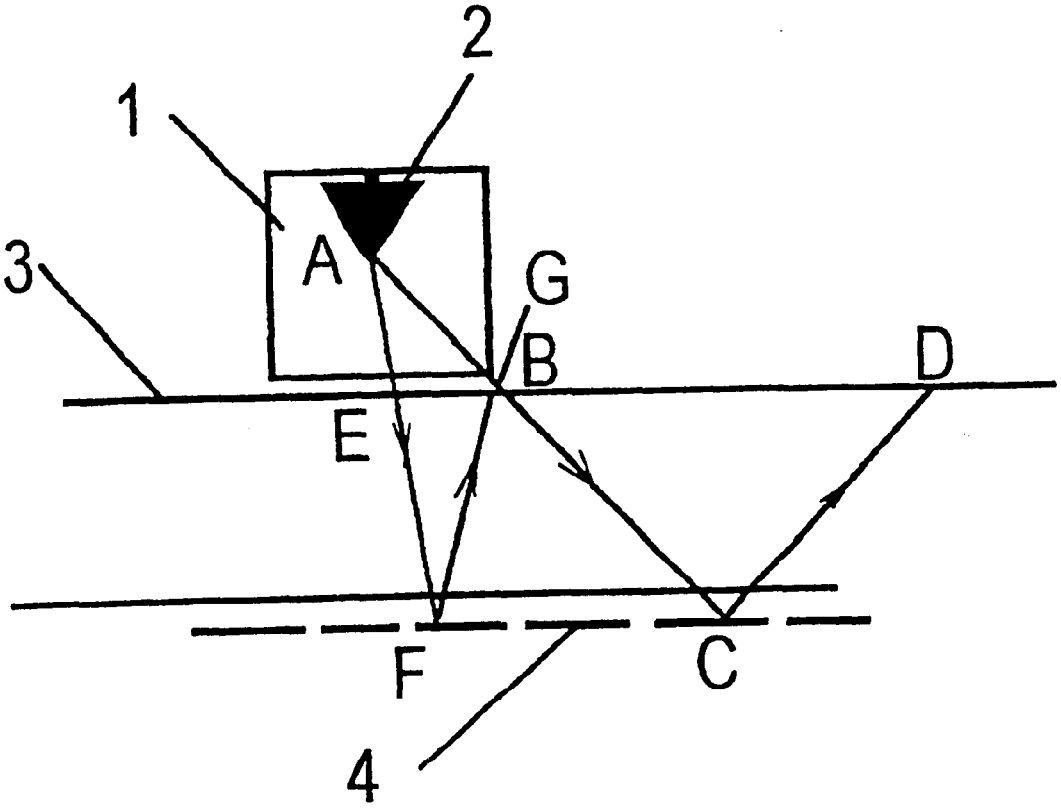
FIG. 7: Explaining sketch for ray paths.

The fundamental principle for shielding according to the invention is shown in FIG. 7. Here 1 is a microwave unit containing a microwave generator 2 and having a bottom surface of about 40×40 centimetres. The unit is used for drying a concrete floor structure 3 with a thickness of about 20 centimetres. At the underside of the structure an aluminium foil 4 is applied. Two ray paths from the microwave source, which for the sake of simplicity has been assumed point formed, have been drawn, one, ABCD, concerns a ray passing the border B of microwave unit's downwards open side. It advances linearly and hits the foil at C, is reflected there and will theoretically hit the upper surface at D, but is then so weakened that no measurable effect remains. The other ray, AEFG, hits the floor structure at E and the foil at F and is reflected to G. This ray, too, has passed through between 40 and 50 centimetres of concrete. According to experience this distance is, with a good margin, sufficient for quenching microwave radiation to barely measurable levels.

This discussion concerns, from microwave aspect, comparatively uniform materials with good quenching capacity. For non-uniform materials, such as plasterboard on crossbars, where one has two thin gypsum slabs with high quenching capacity and an intermediate air space principally without quenching effect, light concrete with air occlusions, hollow bricks etc. the analyse becomes more complicated, as one has to calculate with partial reflection at each passing from one medium to another. Thus, one gets a radiation geometry not suitable for mathematical analyse. However, experience tells that the norm, at least 140 centimetres, from the centre of a radiation source gives a margin of safety. However, it is important that critical points with respect to microwave leakage are observed and controlled by careful measurements. At too high radiation level the shielding is reinforced by foil coverings reaching further out.

It is important that the foil is applied close to the wall, ceiling or floor surface. This is especially true, when the foil is applied to the opposite side of the wall, the ceiling or the floor. Even a very small air gap, for instance some centimetre, impairs the shielding effect substantially. The requirement of closeness concerns especially the border areas of the foil.

To reinforce the foil and prevent unintentional tearing the metal foil should be supported by a paper or plastic sheet. An especially suitable material is so-called kraft paper with a thin aluminium foil of the type that is usually used for packing. It is important that all foil seams are sealed against radiation. This is done by overlapping (at least 10 cm) and sealing in a suitable way. For this purpose tape, especially so called silver tape, has shown suitability.

When metal foil is used as protection against microwaves, the foil is applied close to ceilings, walls and floors according to a special system, the details of which will become more plain by the following drawings. The fundamental principle is that metal foil is used for reflecting the microwave radiation back into the material. Thus, forcing it to pass a longer distance through the building material. The length of this distance depends upon the quenching properties of the material. The quenching effect causes the radiation to decay rapidly to completely safe levels.

Even along pipes and reinforcing iron, which are considered problematic, rapid decay occurs. After about 50 cm from the centre of the radiation source, already, the radiation has decayed to a safe level.

The technique differs significantly from known methods, where one uses so-called microwave cavities, sometimes with so-called capacitive locks, and in this way limits the radiation to a closed space.

The simplest version of the shielding is that the wall in the room where drying occurs is covered with foil. This is suitable, when the drying concerns floors. The covering does not need to be wide. Usually some 10th centimetre from the floor is sufficient. From practical reasons one often uses one breadth of a kraft paper carried aluminium foil, which is usually one metre wide. This is called foil installation type 1 and is used when the space below the floor is not accessible, for instance a concrete slab on the ground.

When working in houses with basements and/or more storeys, one often has to make spaces below the floor safe against radiation. Then foil installation of type 1 is combined with foil installation type 2. This means that the ceiling in the space below the room, where microwaves are used, is covered with foil. To avoid leakage along the wall the foil is turned down against it. The turning down does not need to be large if the floor is not very thin or consists of material with low quenching capacity for microwaves. A couple of centimetres is usually sufficient, but from practical reasons a standard value is suitable. Usually the value 20 cm is used.

Combination of foil installation type 1 and type 2 is from natural reasons the most common and is called elementary foil installation in the following text. Usually elementary foil installation is sufficient, when floors and walls consist of concrete or light concrete or other materials with similar quenching properties for microwaves and the treatment concerns floors.

Even if the wall consists of material with less good quenching property for example gypsum slabs on wooden crossbars, this is no obstacle for the establishment of reliable protection.

The downwards directed radiation causes no need for special shielding at the opposite side of the wall. On the other hand, in the storey below, a shield may be needed at the ceiling even in spaces next to the room just under the one, where microwaves are used.

Figure 1:
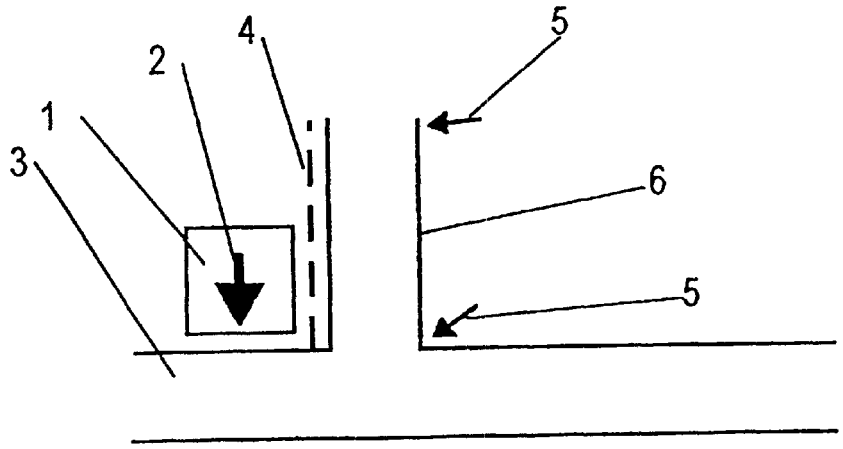
FIGS. 1 to 5 show examples of some different foil arrangements.

FIG. 1 shows an installation appropriate for use with a mobile machine on rails in a room on ground. Here 1 stands for the microwave apparatus, 2 for a microwave generator, usually a magnetron, the point of the arrow denoting the work direction. 3 stands for the floor or the wall treated, 4 for a shielding foil, applied according to the invention, 5 for arrows pointing to critical points regarding microwave radiation and 6 for surrounding walls.

Figure 2:
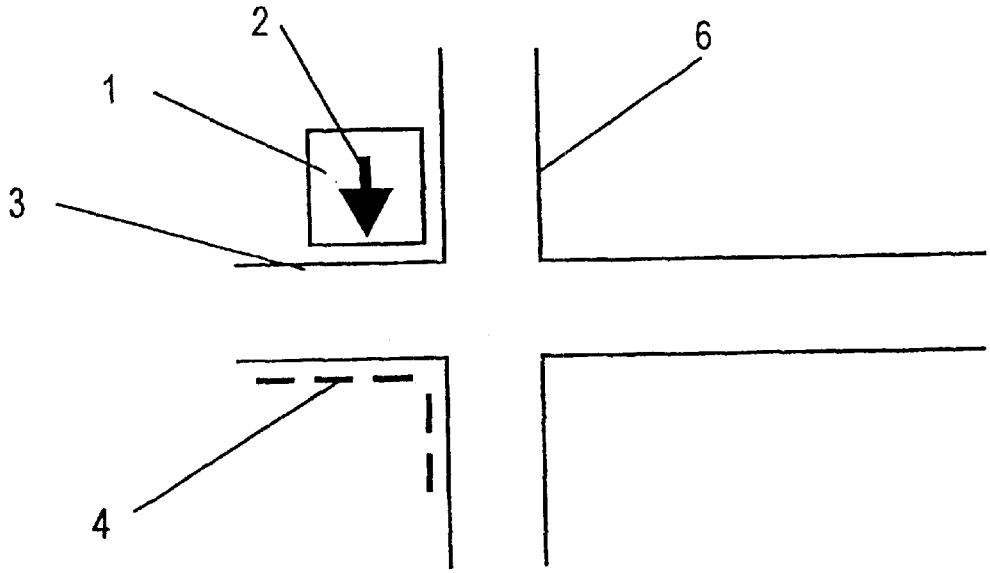

FIG. 2 shows an installation appropriate for use with a mobile machine operating in a room above another room. Here, 1 stands for the microwave apparatus, 2 for a microwave generator, usually a magnetron, the point of the arrow denoting the work direction. 3 stands for the floor or the wall treated, 4 for a shielding foil, applied according to the invention, and 6 for surrounding walls.

Figure 3:
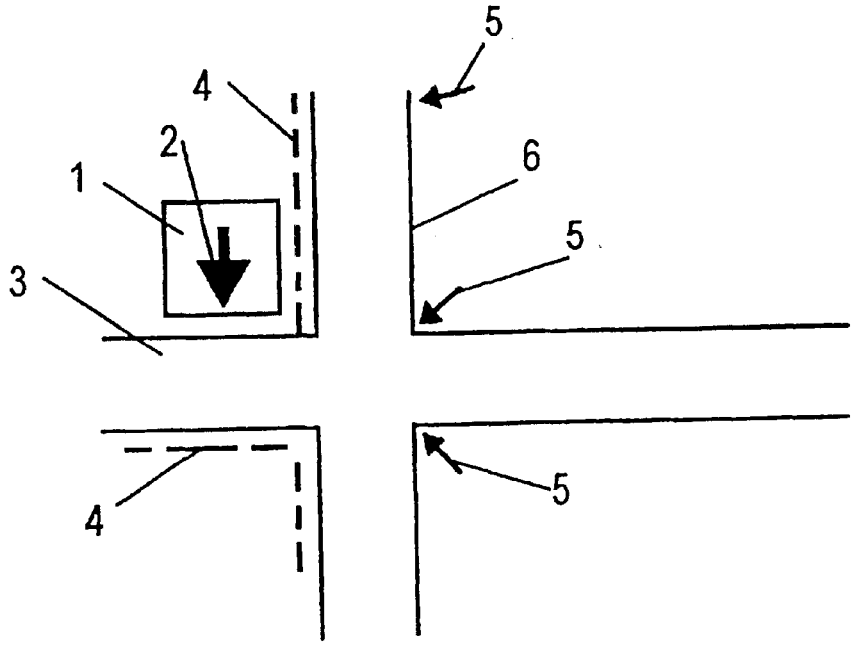

FIG. 3 shows an elementary installation appropriate for floor drying. Here, 1 stands for the microwave apparatus, 2 for a microwave generator, usually a magnetron, the point of the arrow denoting the work direction. 3 stands for the floor or the wall treated, 4 for a shielding foil applied according to the invention, 5 for arrows pointing to critical points regarding microwave radiation and 6 for surrounding walls.

Figure 4:
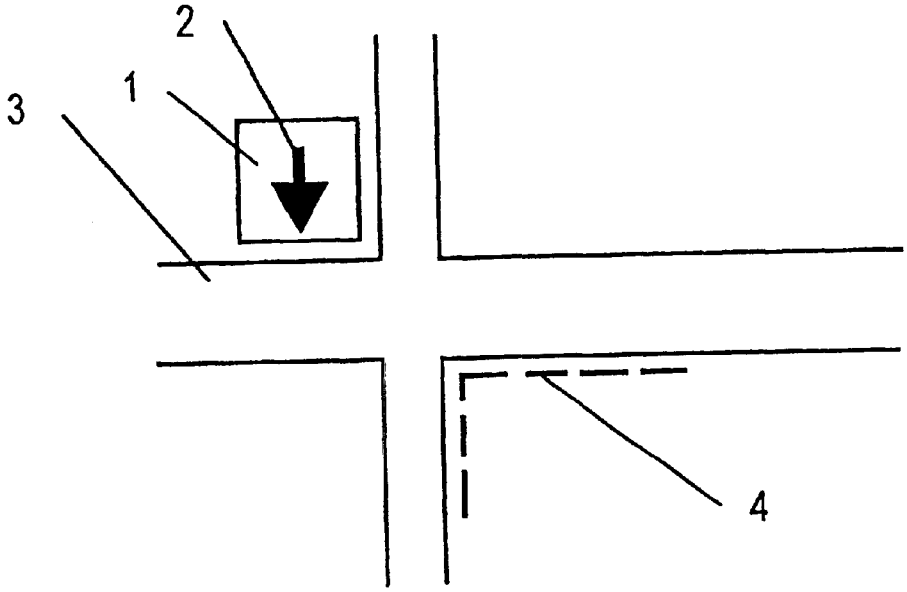

FIG. 4 shows a complement to the elementary installation of FIG. 3. This complement is sometimes needed with surrounding walls consisting of gypsum plates. Here 1 stands for the microwave apparatus, 2 for a microwave generator, usually a magnetron, the point of the arrow denoting the work direction. 3 stands for the floor or the wall treated, 4 for a shielding foil applied according to the invention.

Figure 5:
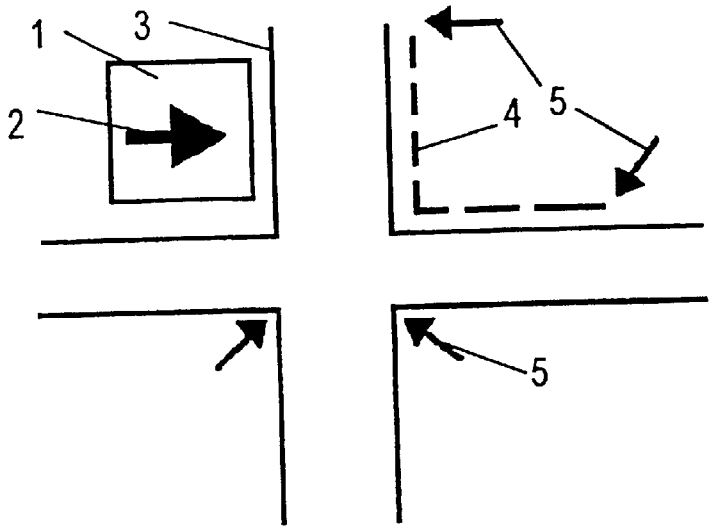

FIG. 5 shows an installation appropriate for use at treatments of walls consisting of light concrete blocks. Here 1 stands for the microwave apparatus, 2 for a microwave generator, usually a magnetron, the point of the arrow denoting the work direction. 3 stands for the floor or the wall treated, 4 for a shielding foil applied according to the invention, 5 for arrows pointing to critical points regarding microwave radiation and 6 for surrounding walls.

Figure 6:
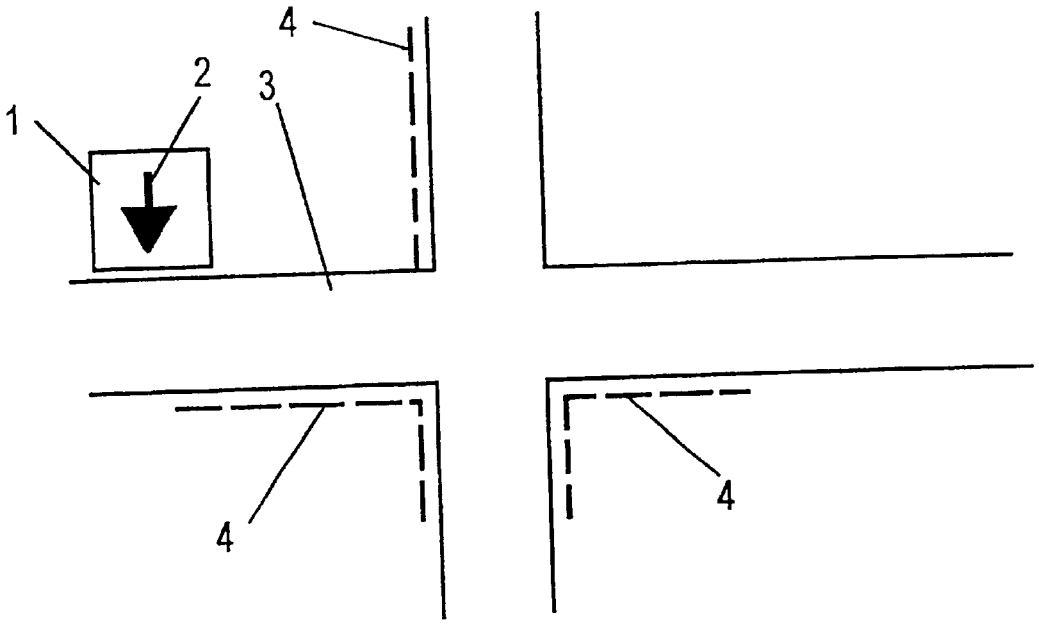
FIG. 6: Elementary foil installation at drying of hollow brick, hollow block or wooden walls and wooden floor structure.

FIG. 6 shows a type of installation appropriate for the drying of hollow brick, hollow block or wooden walls and wooden floor structures. Here 1 stands for the microwave apparatus, 2 for a microwave generator, usually a magnetron, the point of the arrow denoting the work direction. 3 stands for the floor or the wall treated, 4 for a shielding foil applied according to the invention. Critical areas with regard to microwave radiation may appear at foil borders and floor to wall angles. Control measurements at such critical points, designated with 5 in the figures, should be made.

It should be observed that one at drying of for instance walls of material with low quenching effect and foil applied at the outer side of the wall with respect to the microwave source gets reflected radiation into the room, where drying occurs. Then this space may be a dangerous area. At such drying measures must be taken to protect the operator from radiation, for instance by remote control or partial covering of the inside by foil.

What is claimed is:

1. Method for shielding against dangerous magnetic radiation during drying of a surface of a water damaged building part by one or more mobile unit(s) emitting microwave radiation directed against the surface that is being dried wherein the inherent quenching effect in concrete, light concrete, gypsum, filled structures or a similar building part material is utilized and reinforced by installation of a temporary, partial covering of surrounding walls, ceilings or floors of the building part, and wherein said covering is applied to the opposite side of said walls, ceilings or floors of the building part to that exposed to microwave radiation, and is removed following drying, said covering consisting of a metal foil which reflects the radiation back into the building part.

2. The method of claim 1 wherein the metal foil is applied so that the radiation has to pass through at least 50 cm of the building material.

3. The method of claim 1 wherein the metal foil is an aluminum foil.

4. Method for shielding against dangerous magnetic radiation during drying of a surface of a water damaged building part by one or more mobile unit(s) emitting microwave radiation against the surface that is being dried, which method comprises installing a temporary, metal foil as a partial covering of the surface to be dried, wherein said covering is applied to the opposite side of the surface to be dried to that exposed to microwave radiation, and is removed following drying, so that microwave radiation can be reflected back towards the surface exposed to microwave radiation while allowing evaporated water to escape from said surface.

5. The method according to claim 4 wherein the foil is applied to cause the radiation to pass through at least 50 cm of the building material, to utilize the inherent quenching effect of the building material to help dry the water damaged building part surface.

6. The method according to claim 4 wherein the foil is an aluminum foil.

* * * * *